US012022927B1

(12) United States Patent
Barton

(10) Patent No.: US 12,022,927 B1
(45) Date of Patent: Jul. 2, 2024

(54) LUGGAGE LOCATING SYSTEM

(71) Applicant: Michael Barton, Riverside, CA (US)

(72) Inventor: Michael Barton, Riverside, CA (US)

( * ) Notice: Subject to any disclaimer, the term of this patent is extended or adjusted under 35 U.S.C. 154(b) by 0 days.

(21) Appl. No.: 18/209,720

(22) Filed: Jun. 14, 2023

(51) Int. Cl.
*A45C 13/42* (2006.01)
*A45C 5/03* (2006.01)
*A45C 15/06* (2006.01)

(52) U.S. Cl.
CPC ..... *A45C 13/42* (2013.01); *A45C 5/03* (2013.01); *A45C 15/06* (2013.01)

(58) Field of Classification Search
CPC ..... A45C 15/06; A45C 5/03; A45C 13/42
See application file for complete search history.

(56) References Cited

U.S. PATENT DOCUMENTS

| | | | |
|---|---|---|---|
| 6,147,602 A | 11/2000 | Bender | |
| 6,304,183 B1 | 10/2001 | Causey | |
| 6,975,221 B2 | 12/2005 | Monck | |
| D514,241 S | 1/2006 | Franks | |
| 7,557,705 B2 | 7/2009 | Oas | |
| D952,911 S | 5/2022 | Luo | |
| 2010/0259408 A1 | 10/2010 | Berger | |
| 2017/0049205 A1 | 2/2017 | Tekin | |
| 2018/0213907 A1 | 8/2018 | Haggan | |

FOREIGN PATENT DOCUMENTS

| | | | |
|---|---|---|---|
| CA | 2606993 | 4/2008 | |
| GB | 2581937 A * | 9/2020 | ..... A45C 13/42 |

OTHER PUBLICATIONS

Innovation Q+ NPL Search (Year: 2023).*

* cited by examiner

*Primary Examiner* — Anabel Ton

(57) ABSTRACT

A luggage locating system for locating personal luggage includes a piece of luggage and a light emitting assembly mounted to the piece of luggage and comprising a plurality of light emitters. A remote controller is in wireless communication with the light emitting assembly via transmission circuitry and is actuatable to activate the plurality of light emitters.

19 Claims, 9 Drawing Sheets

LUGGAGE LOCATING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to locating systems and more particularly pertains to a new locating system for locating personal luggage.

(2) Description of Related Art Including Information Disclosed Under 37 CFR 1.97 and 1.98

The prior art describes various luggage location systems which emit light to facilitate a user locating the user's luggage. however, the prior art fails to disclose such an apparatus in which a plurality of light emitters are embedded into an exterior surface of a piece of luggage, providing a flush surface such that the light emitters do not protrude from the luggage in a manner that leaves them prone to damage due to a concentration of force being placed on the protruding light emitters.

BRIEF SUMMARY OF THE INVENTION

An embodiment of the disclosure meets the needs presented above by generally comprising a piece of luggage and a light emitting assembly mounted to the piece of luggage and comprising a plurality of light emitters. A processor is in operational communication with the plurality of light emitters of the light emitting assembly and is programmed to selectively activate the plurality of light emitters of the light emitting assembly to emit light. A receiver is in operational communication with the processor. A light power supply 44 is electrically coupled to the processor. A remote controller is in wireless communication with the receiver. The remote controller comprises a transmitter, an activation switch, and a controller power supply. The transmitter is programmed to transmit an activation signal to the receiver to activate the plurality of light emitters of the light emitting assembly. The activation switch is operatively coupled to the transmitter wherein the activation switch selectively activates the transmitter. The controller power supply is in communication with the activation switch.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
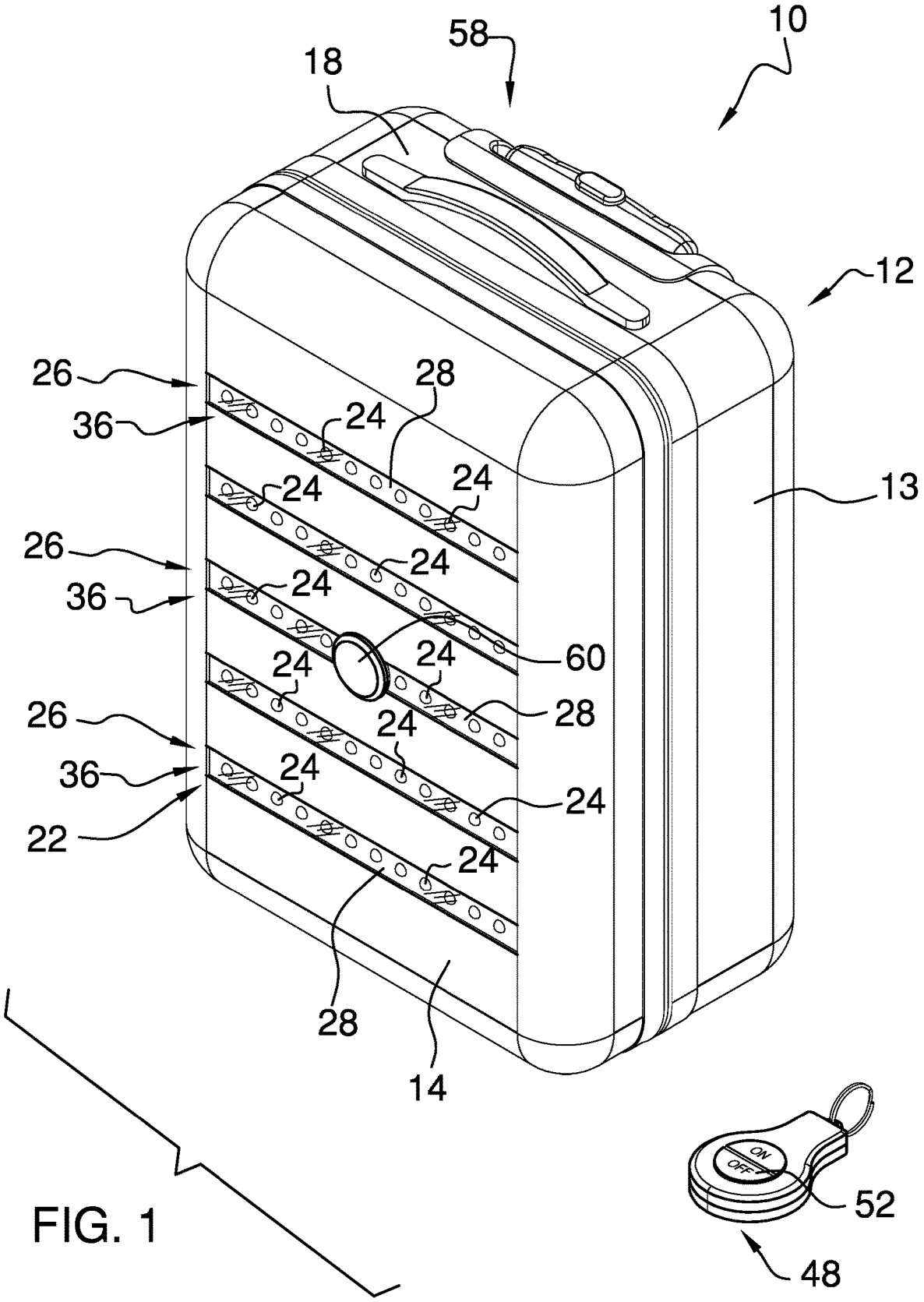
FIG. 1 is a perspective view of a luggage locating system according to a first embodiment of the disclosure.
Figure 2:
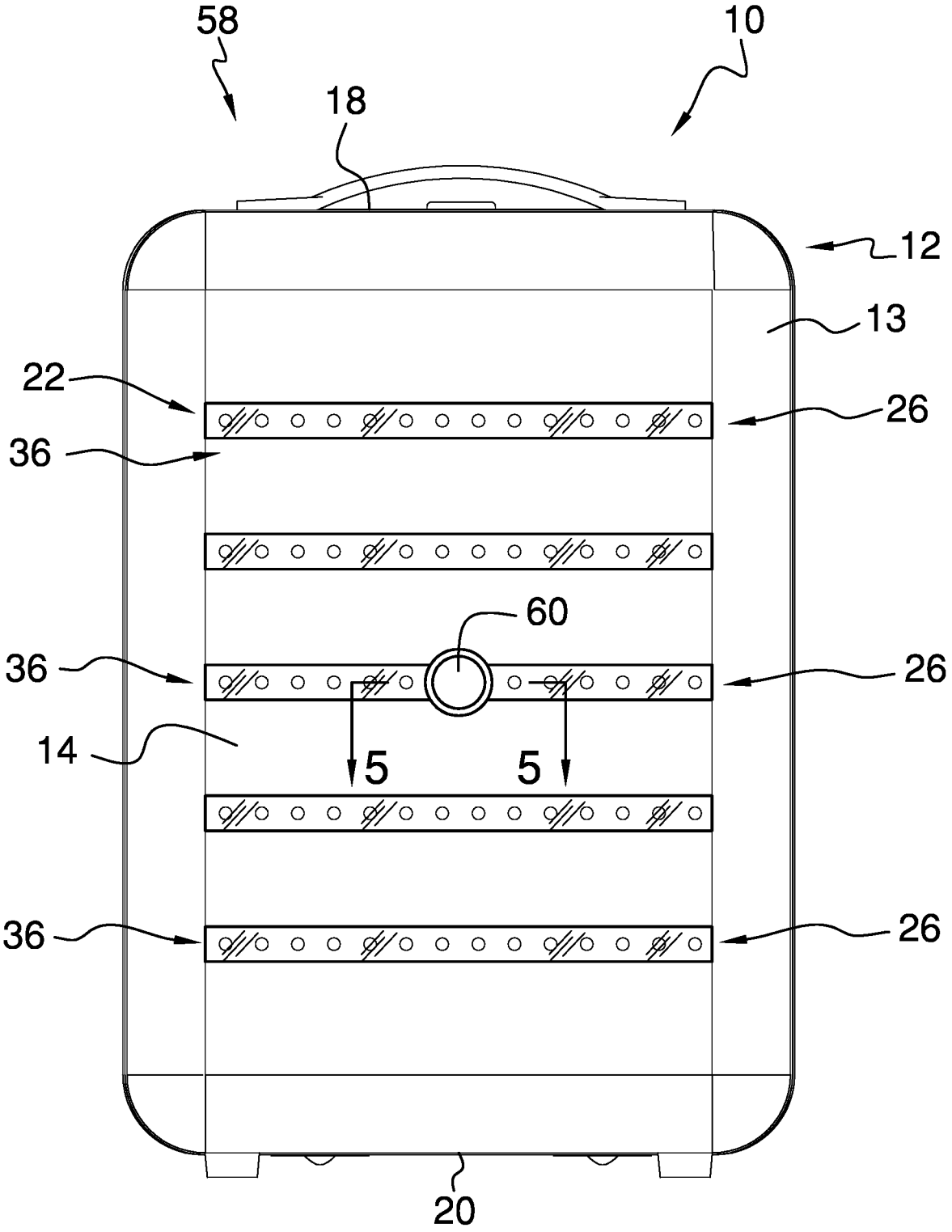
FIG. 2 is a front view of a piece of luggage of the first embodiment of the disclosure.
Figure 3:
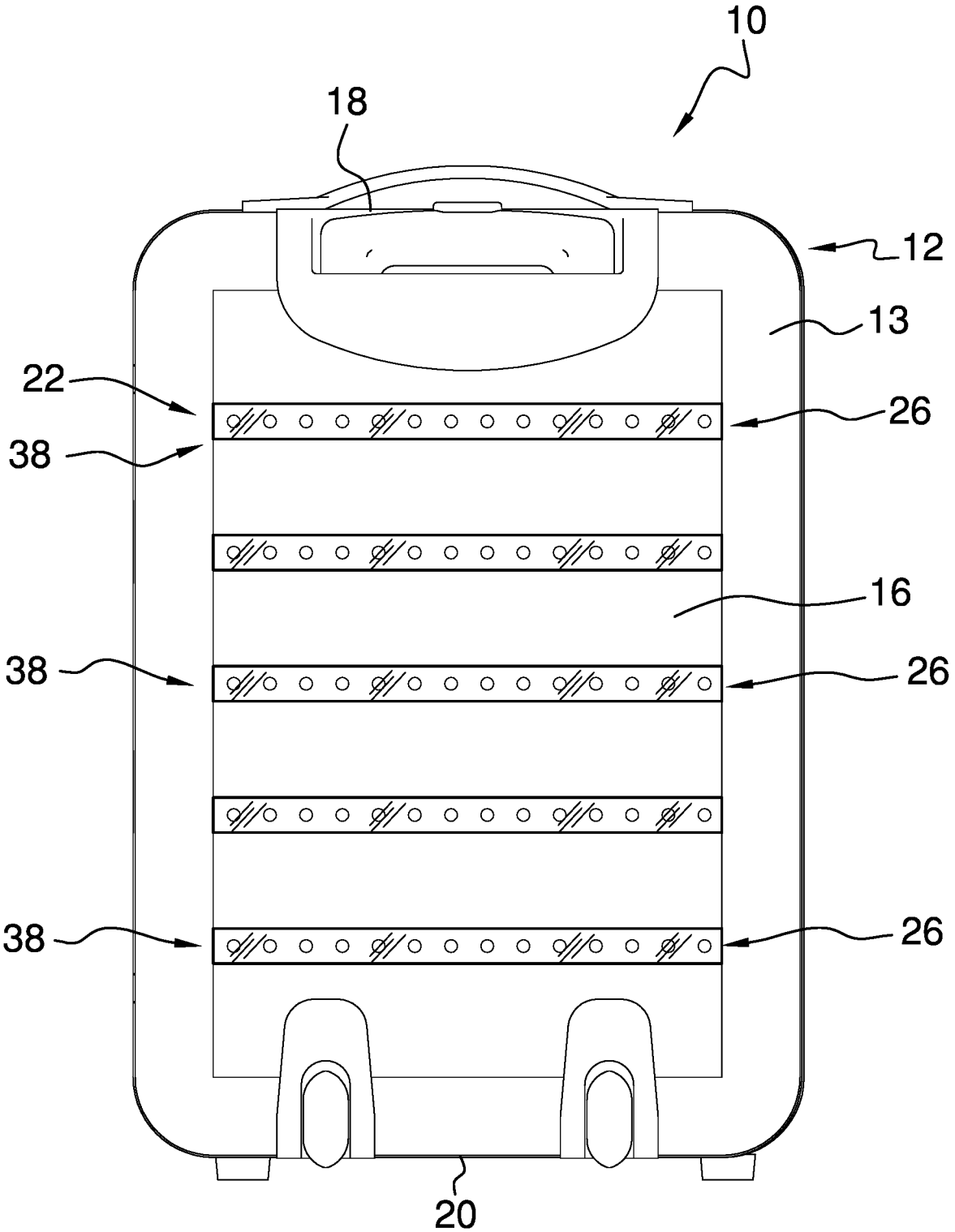
FIG. 3 is a back view of the piece of luggage of the first embodiment of the disclosure.
Figure 4:
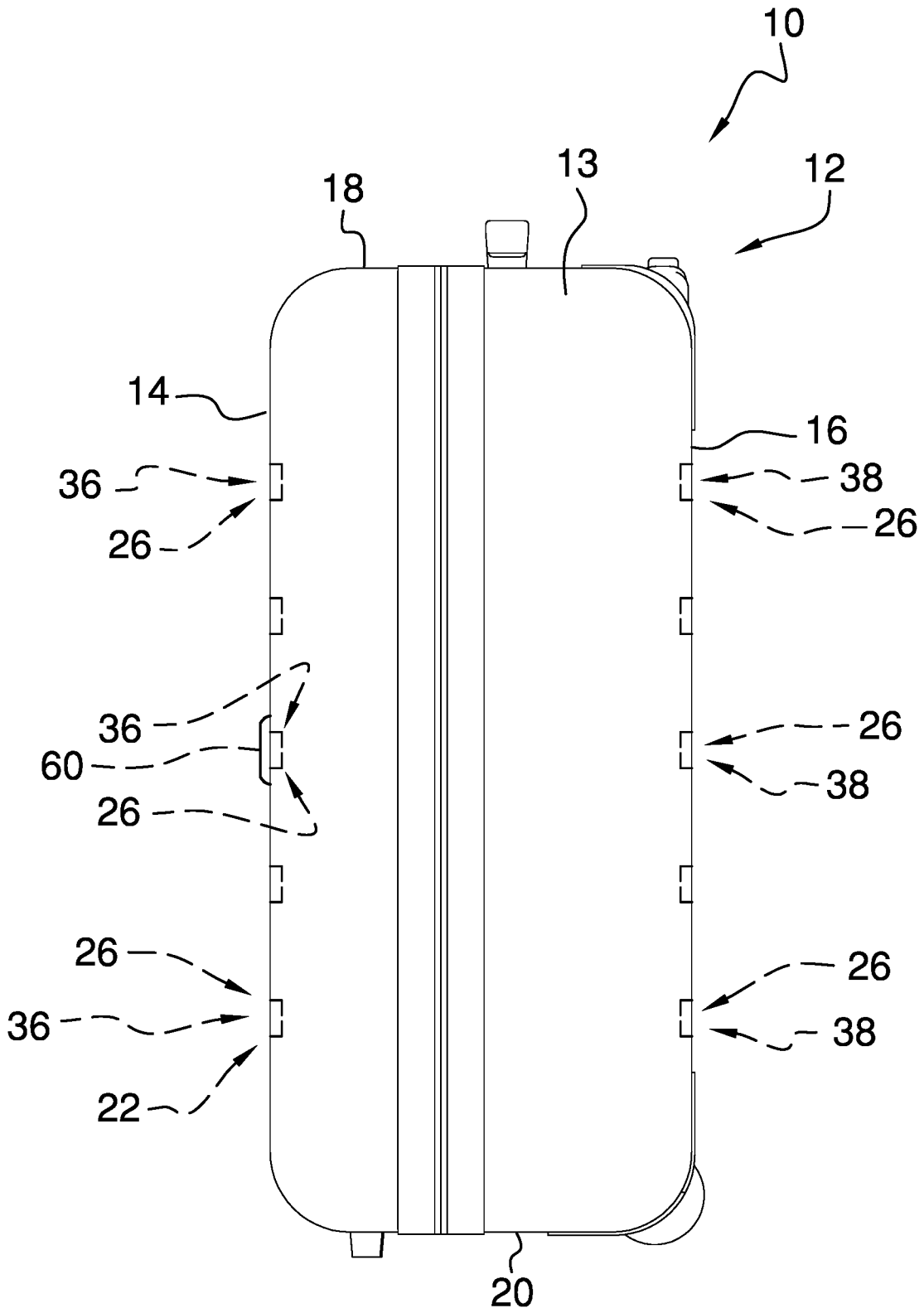
FIG. 4 is a side view of the piece of luggage of the first embodiment of the disclosure.
Figure 5:
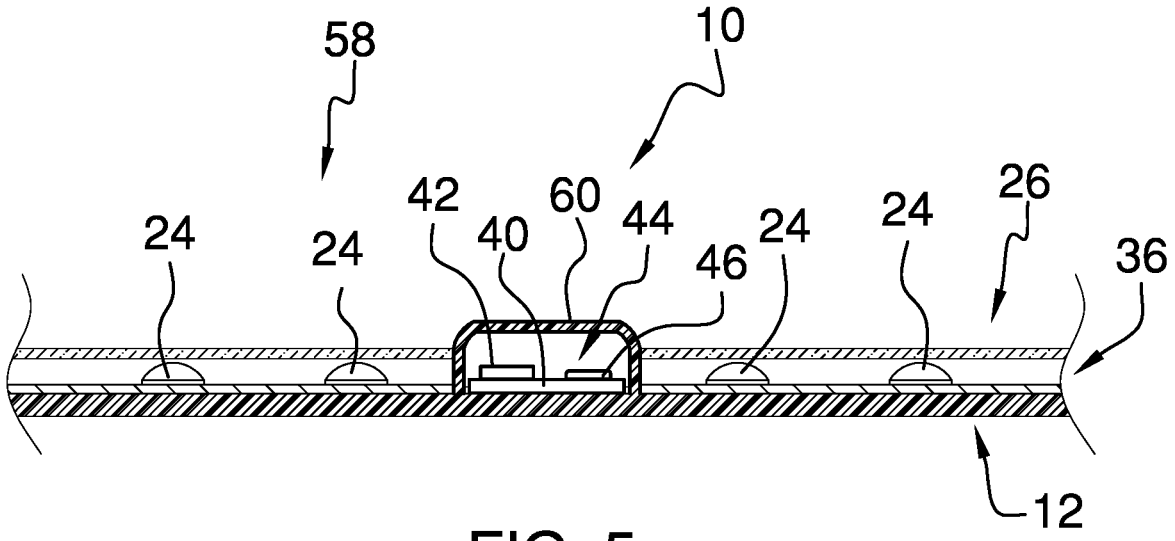
FIG. 5 is a cross-section view of the piece of luggage of the first embodiment of the disclosure taken from Arrows 5-5 in FIG. 2.
Figure 6:
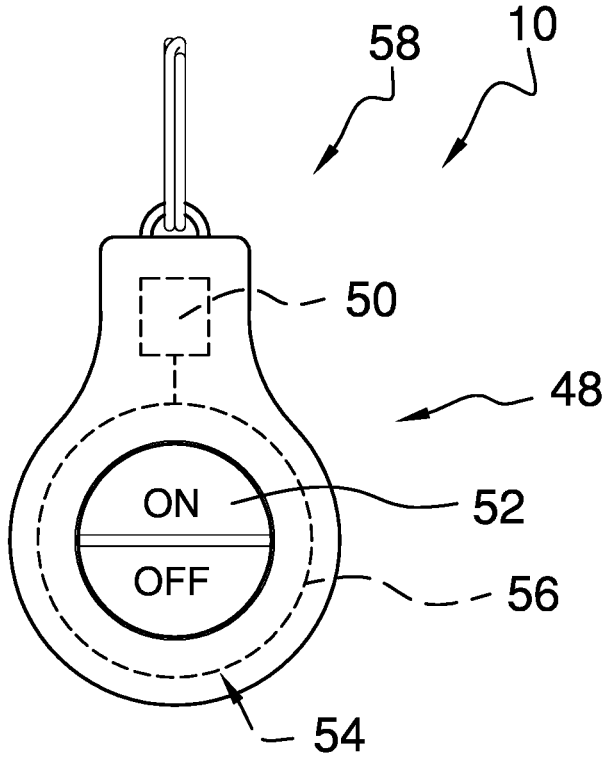
FIG. 6 is a front view of a remote controller of the first embodiment of the disclosure.
Figure 7:
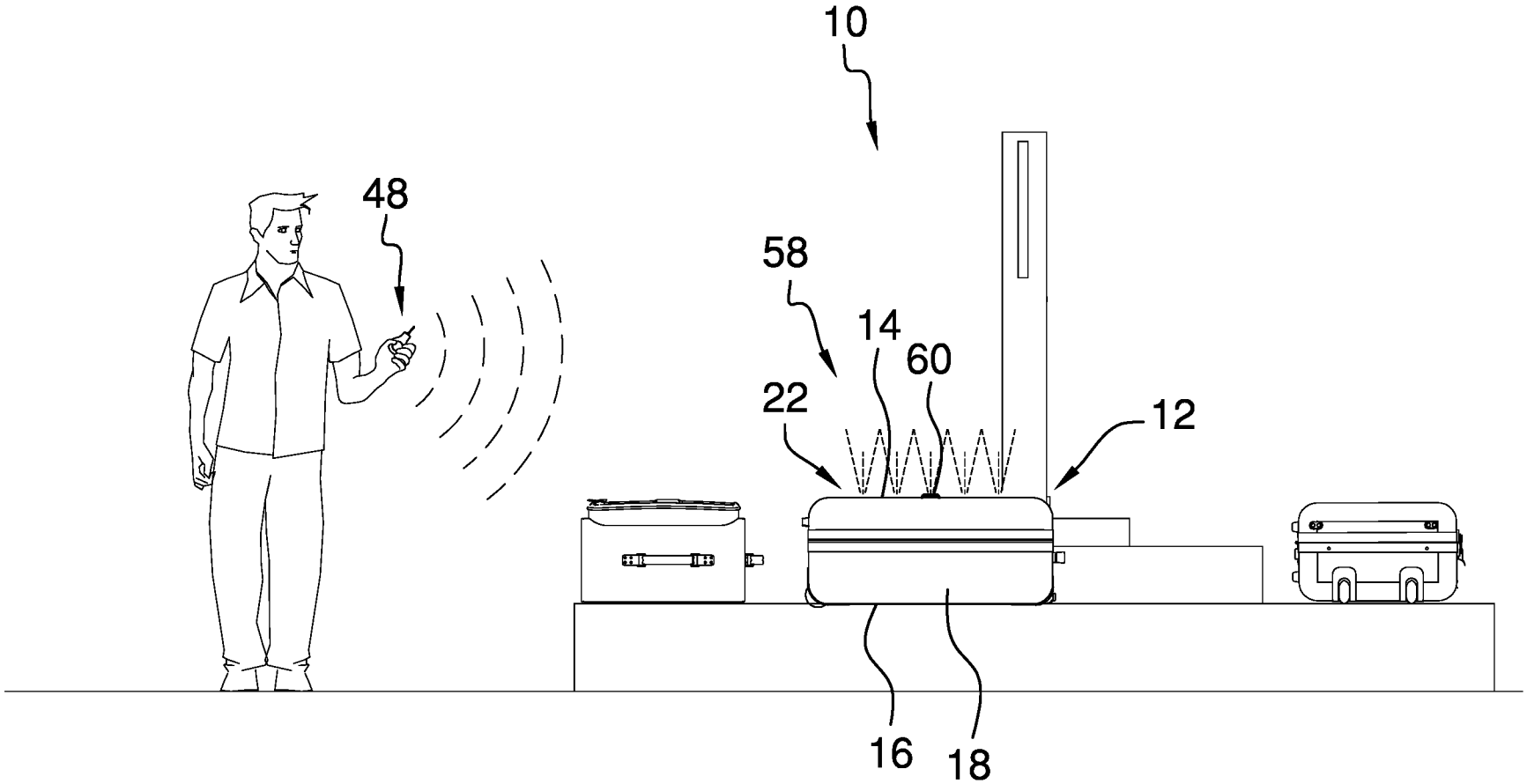
FIG. 7 is an in-use view of the first embodiment of the disclosure.
Figure 8:
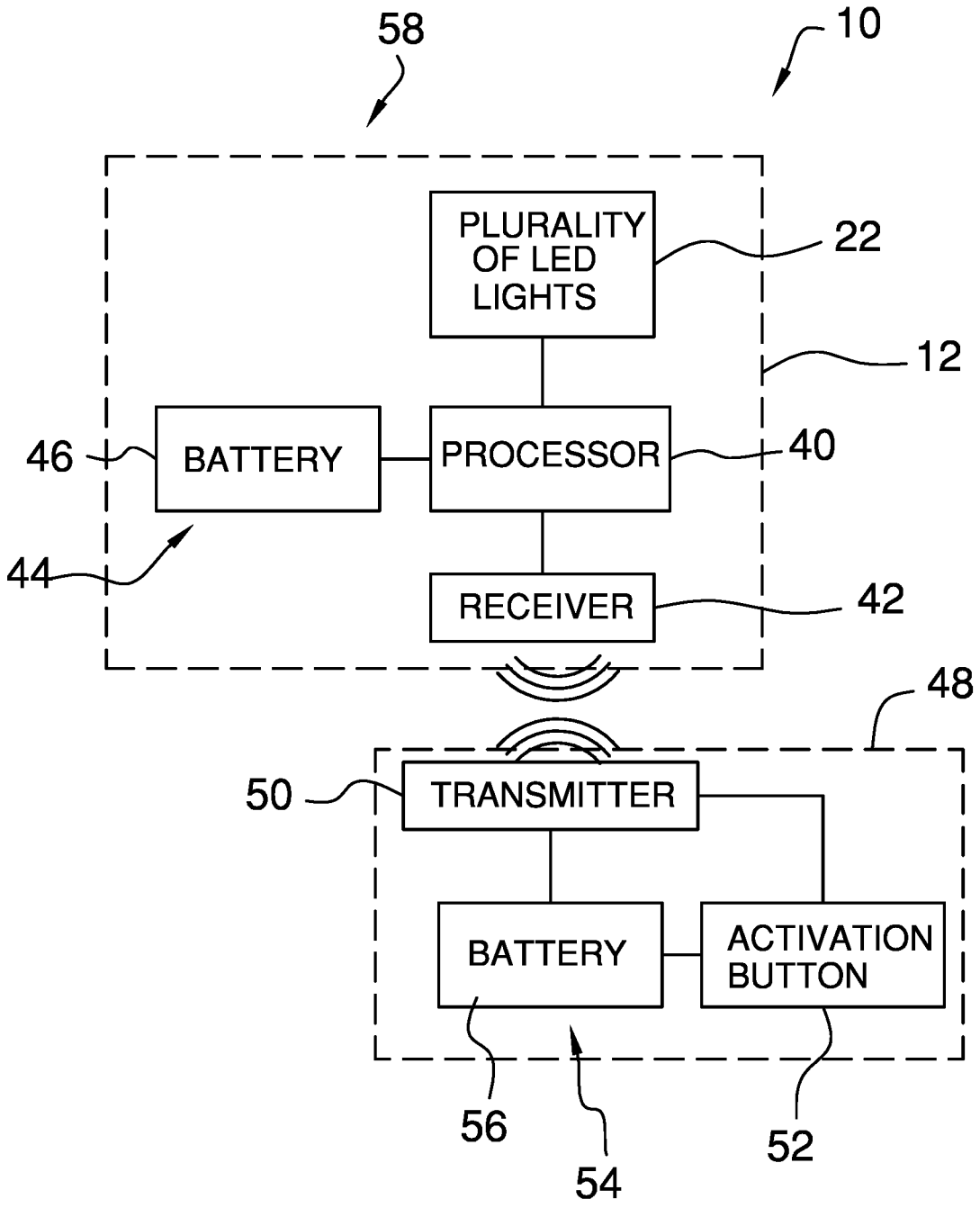
FIG. 8 is a block diagram of the first embodiment of the disclosure.
Figure 9:
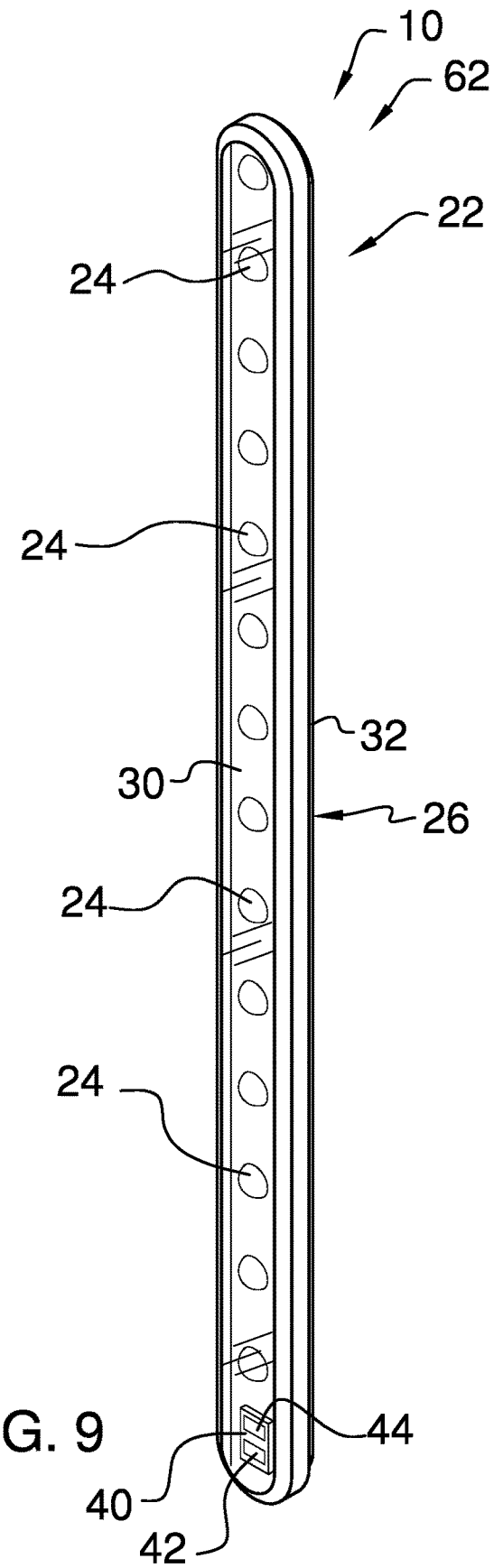
FIG. 9 is a perspective view of a light housing of a second embodiment of the disclosure.
Figure 10:
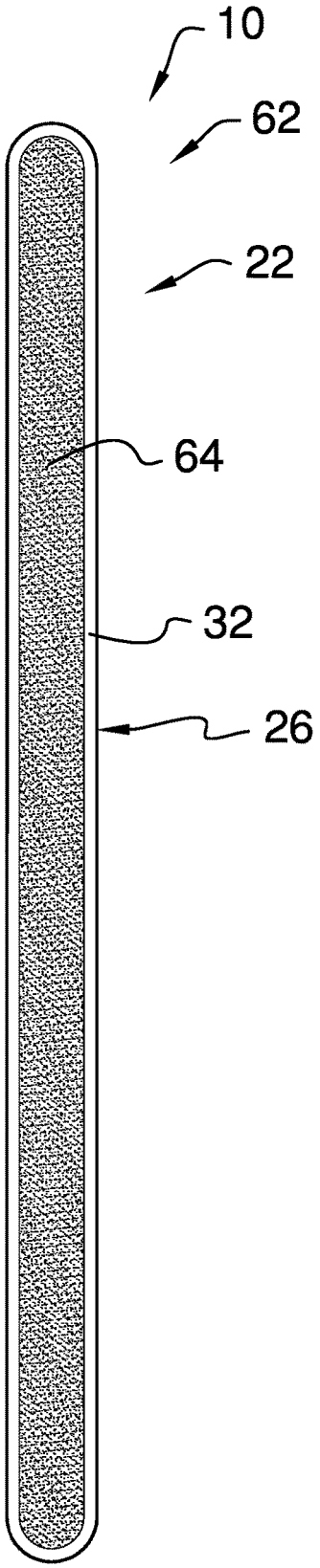
FIG. 10 is a back view of the light housing of the second embodiment of the disclosure.
Figure 11:
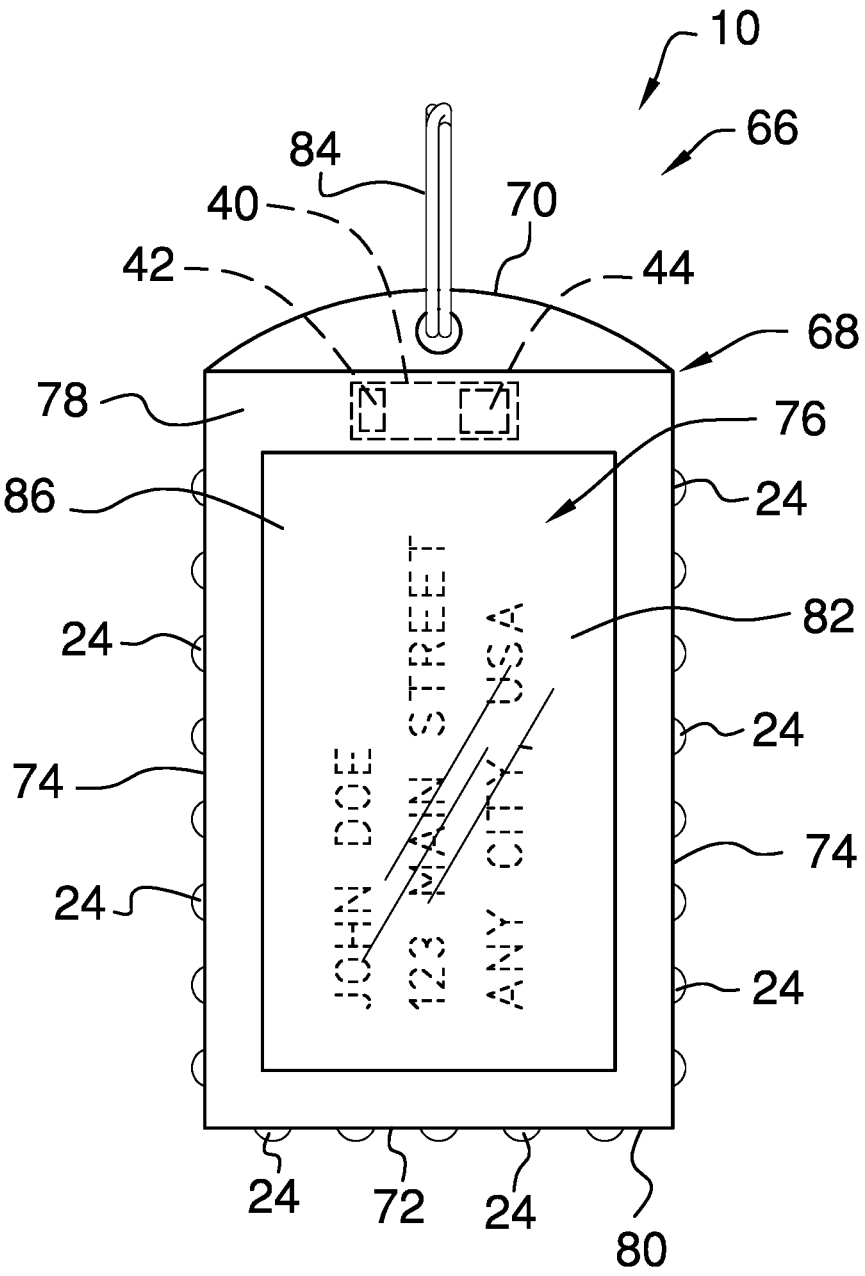
FIG. 11 is a front view of a luggage tag of a third embodiment of the disclosure.

With reference now to the drawings, and in particular to FIGS. 1 through 11 thereof, a new locating system embodying the principles and concepts of an embodiment of the disclosure and generally designated by the reference numeral 10 will be described.

As best illustrated in FIGS. 1 through 11, the luggage locating system 10 generally comprises a piece of luggage 12 and a light emitting assembly 22 mounted to the piece of luggage 12 and comprising a plurality of light emitters 24. A processor 40 is in operational communication with the plurality of light emitters 24 of the light emitting assembly 22 and is programmed to selectively activate the plurality of light emitters 24 of the light emitting assembly 22 to emit light. A receiver 42 is in operational communication with the processor 40. A light power supply 44 is electrically coupled to the processor 40 and comprises a light battery 46. A remote controller 48 is in wireless communication with the receiver 42. The remote controller 48 comprises a transmitter 50, an activation switch 52, and a controller power supply 54. The transmitter 50 is programmed to transmit an activation signal to the receiver 42 to activate the plurality of light emitters 24 of the light emitting assembly 22. The activation switch 52 is operatively coupled to the transmitter 50 wherein the activation switch 52 selectively activates the transmitter 50. The controller power supply 54 is in communication with the activation switch 52 and comprises a controller battery 56.

In a first embodiment 58, the light emitting assembly 22 comprises a plurality of light housings 26 which each contain an associated group of light emitters 24 of a plurality of groups of light emitters 24 of the plurality of light emitters 24. A portion 28 of each light housing 26 is translucent to facilitate transmission of light through the portion 28 of the light housing 26. Each light housing 26 of the plurality of light housings 26 is elongated, and the associated group of light emitters 24 of each light housing 26 of the plurality of light housings 26 is arranged longitudinally along the light housing 26. The plurality of light housings 26 is mounted on an exterior 13 of the piece of luggage 12. Each light housing 26 of the plurality of light housings 26 is flush with the exterior 13. The plurality of light housings 26 include a set of first light housings 36 which is positioned on a front side 14 of the piece of luggage 12 and a set of second light housings 38 which is positioned on a rear side 16 of the piece of luggage 12. Each of the set of first light housings 36 and the set of second light housings 38 is arranged between a top end 18 and a bottom end 20 of the piece of luggage 12. An electronics housing 60 is mounted to the front side 14 of the piece of luggage 12 and houses each of the processor 40, the receiver 42, and the light power supply 44.

In a second embodiment 62, the light emitting assembly 22 comprises a light housing 26 containing the plurality of light emitters 24. A first surface 30 of the light housing 26 is translucent to facilitate transmission of light through the first surface 30 of the light housing 26. The light housing 26 is elongated, and the plurality of light emitters 24 is arranged longitudinally along the light housing 26. The light housing 26 contains each of the processor 40, the receiver 42, and the light power supply 44. An adhesive 64 is coupled to a second side 80 of the light housing 26 opposite the first surface 30 of the light housing 26. The adhesive 64 mounting the light emitting assembly 22 to an exterior 13 of the piece of luggage 12. The light housing 26 may also attach to the piece of luggage 12 via a hook-and-loop fastener, a tie, a sewn thread, or the like.

In a third embodiment 66 of the housing, a luggage tag 68 is mounted to the piece of luggage 12, and the plurality of light emitters 24 is mounted to the piece of luggage 12 via the luggage tag 68. The luggage tag 68 has a first end 70, a second end 72, and a pair of lateral edges 74 each extending between the first end 70 and the second end 72. The plurality of light emitters 24 is arranged along each of the second end 72 and the pair of lateral edges 74. Each of the processor 40, the receiver 42, and the light power supply 44 is mounted in the luggage tag 68.

The luggage tag 68 defines a cavity 76 therein. The luggage tag 68 has a first side 78 and a second side 80 positioned opposite each other and each extending between the first end 70 and the second end 72 and between the pair of lateral edges 74. A portion 82 of the first side 78 is translucent to facilitated viewing into the cavity 76 through the portion 82 of the first side 78. The cavity 76 is configured for containing an identification card 86, and the portion 82 of the first side 78 is configured for facilitating viewing the identification card 86 through the portion 82 of the first side 78. A key ring 84 is coupled to the first end 70 of the luggage tag 68 for mounting the luggage tag 68 to the piece of luggage 12. The luggage tag 68 may also attach to the piece of luggage 12 via a hook-and-loop fastener, a tie, a strap, or the like.

In use, the activation switch 52 of the remote controller 48 is actuated to activate the plurality of lights of the light assembly, thereby aiding in locating the piece of luggage 12. The plurality of lights may be programmed to emit light in a pattern to draw attention to the piece of luggage 12. For example, the pattern may include flashing lights, dimming and brightening lights, or the like. The light emitters 24 also may be configured to emit light in particular wavelengths to produce different colors.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A luggage locating system comprising:

a piece of luggage;

a light emitting assembly being mounted to the piece of luggage and comprising a plurality of light emitters;

a processor being in operational communication with the plurality of light emitters of the light emitting assembly, the processor being programmed to selectively activate the plurality of light emitters of the light emitting assembly to emit light;

a receiver being in operational communication with the processor;

a light power supply being electrically coupled to the processor;

a remote controller being in wireless communication with the receiver, the remote controller comprising:

a transmitter being programmed to transmit an activation signal to the receiver to activate the plurality of light emitters of the light emitting assembly;

an activation switch being operatively coupled to the transmitter wherein the activation switch selectively activates the transmitter; and a controller power supply being in communication with the activation switch; and wherein the light power supply comprises a light battery.

2. A luggage locating system comprising:
a piece of luggage;
a light emitting assembly being mounted to the piece of luggage and comprising a plurality of light emitters;
a processor being in operational communication with the plurality of light emitters of the light emitting assembly, the processor being programmed to selectively activate the plurality of light emitters of the light emitting assembly to emit light;
a receiver being in operational communication with the processor;
a light power supply being electrically coupled to the processor;
a remote controller being in wireless communication with the receiver, the remote controller comprising:
a transmitter being programmed to transmit an activation signal to the receiver to activate the plurality of light emitters of the light emitting assembly;
an activation switch being operatively coupled to the transmitter wherein the activation switch selectively activates the transmitter, and
a controller power supply being in communication with the activation switch, wherein the controller power supply comprises a controller battery.

3. A luggage locating system comprising:
a piece of luggage;
a light emitting assembly being mounted to the piece of luggage and comprising a plurality of light emitters;
a processor being in operational communication with the plurality of light emitters of the light emitting assembly, the processor being programmed to selectively activate the plurality of light emitters of the light emitting assembly to emit light;
a receiver being in operational communication with the processor;
a light power supply being electrically coupled to the processor;
a remote controller being in wireless communication with the receiver, the remote controller comprising:
a transmitter being programmed to transmit an activation signal to the receiver to activate the plurality of light emitters of the light emitting assembly;
an activation switch being operatively coupled to the transmitter wherein the activation switch selectively activates the transmitter; and
a controller power supply being in communication with the activation switch; and
wherein the light emitting assembly comprises a plurality of light housings, each light housing containing an associated group of light emitters of a plurality of groups of light emitters of the plurality of light emitters, a portion of each light housing being translucent to facilitate transmission of light through the portion of the light housing, the plurality of light housings being mounted on an exterior of the piece of luggage.

4. The system of claim 3, wherein each light housing of the plurality of light housings is elongated, the associated group of light emitters of each light housing of the plurality of light housings being arranged longitudinally along the light housing.

5. The system of claim 3, wherein each light housing of the plurality of light housings is flush with the exterior.

6. The system of claim 3, wherein the plurality of light housings includes a set of first light housings positioned on a front side of the piece of luggage and a set of second light housings being positioned on a rear side of the piece of luggage.

7. The system of claim 3, wherein each of the set of first light housings and the set of second light housings is arranged between a top end and a bottom end of the piece of luggage.

8. The system of claim 3, further comprising an electronics housing being mounted to the front side of the piece of luggage and houses each of the processor, the receiver, and the light power supply.

9. A luggage locating system comprising:
a piece of luggage;
a light emitting assembly being mounted to the piece of luggage and comprising a plurality of light emitters;
a processor being in operational communication with the plurality of light emitters of the light emitting assembly, the processor being programmed to selectively activate the plurality of light emitters of the light emitting assembly to emit light;
a receiver being in operational communication with the processor;
a light power supply being electrically coupled to the processor;
a remote controller being in wireless communication with the receiver, the remote controller comprising:
a transmitter being programmed to transmit an activation signal to the receiver to activate the plurality of light emitters of the light emitting assembly;
an activation switch being operatively coupled to the transmitter wherein the activation switch selectively activates the transmitter; and
a controller power supply being in communication with the activation switch; and
wherein the light emitting assembly comprises a light housing containing the plurality of light emitters, a first surface of the light housing being translucent to facilitate transmission of light through the first surface of the light housing.

10. The system of claim 9, wherein the light housing is elongated, the plurality of light emitters being arranged longitudinally along the light housing.

11. The system of claim 9, wherein the light housing contains each of the processor, the receiver, and the light power supply.

12. The system of claim 9, further comprising an adhesive being coupled to a second side of the light housing opposite the first surface of the light housing, the adhesive mounting the light emitting assembly to an exterior of the piece of luggage.

13. A luggage locating system comprising:
a piece of luggage;
a light emitting assembly being mounted to the piece of luggage and comprising a plurality of light emitters;
a processor being in operational communication with the plurality of light emitters of the light emitting assembly, the processor being programmed to selectively activate the plurality of light emitters of the light emitting assembly to emit light;
a receiver being in operational communication with the processor;
a light power supply being electrically coupled to the processor;
a remote controller being in wireless communication with the receiver, the remote controller comprising:
a transmitter being programmed to transmit an activation signal to the receiver to activate the plurality of light emitters of the light emitting assembly;

an activation switch being operatively coupled to the transmitter wherein the activation switch selectively activates the transmitter; and a controller power supply being in communication with the activation switch; and a luggage tag being mounted to the piece of luggage, the plurality of light emitters being mounted to the piece of luggage via the luggage tag, the luggage tag having a first end, a second end, and a pair of lateral edges, each lateral edge of the pair of lateral edges extending between the first end and the second end, the plurality of light emitters being arranged along each of the second end and the pair of lateral edges, each of the processor, the receiver, and the light power supply being mounted in the luggage tag.

14. The system of claim 13, wherein the luggage tag defines a cavity therein, the luggage tag having a first side and a second side being positioned opposite each other and each extending between the first end and the second end and between the pair of lateral edges, a portion of the first side being translucent to facilitated viewing into the cavity through the portion of the first side, the cavity being configured for containing an identification card, the portion of the first side being configured for facilitating viewing the identification card through the portion of the first side.

15. The system of claim 13, further comprising a key ring being coupled to the first end of the luggage tag for mounting the luggage tag to the piece of luggage.

16. A luggage locating system comprising:

a piece of luggage;

a light emitting assembly being mounted to the piece of luggage and comprising a plurality of light emitters;

a processor being in operational communication with the plurality of light emitters of the light emitting assembly, the processor being programmed to selectively activate the plurality of light emitters of the light emitting assembly to emit light;

a receiver being in operational communication with the processor;

a light power supply being electrically coupled to the processor, the light power supply comprising a light battery; and a remote controller being in wireless communication with the receiver, the remote controller comprising:

a transmitter being programmed to transmit an activation signal to the receiver to activate the plurality of light emitters of the light emitting assembly;

an activation switch being operatively coupled to the transmitter wherein the activation switch selectively activates the transmitter; and a controller power supply being in communication with the activation switch, the controller power supply comprising a controller battery.

17. The system of claim 16, wherein:

the light emitting assembly comprises a plurality of light housings, each light housing containing an associated group of light emitters of a plurality of groups of light emitters of the plurality of light emitters, a portion of each light housing being translucent to facilitate transmission of light through the portion of the light housing, each light housing of the plurality of light housings being elongated, the associated group of light emitters of each light housing of the plurality of light housings being arranged longitudinally along the light housing, the plurality of light housings being mounted on an exterior of the piece of luggage, each light housing of the plurality of light housings being flush with the exterior, the plurality of light housings including a set of first light housings positioned on a front side of the piece of luggage and a set of second light housings being positioned on a rear side of the piece of luggage, each of the set of first light housings and the set of second light housings being arranged between a top end and a bottom end of the piece of luggage; and an electronics housing is mounted to the front side of the piece of luggage and houses each of the processor, the receiver, and the light power supply.

18. The system of claim 16, wherein:

the light emitting assembly comprises a light housing containing the plurality of light emitters, a first surface of the light housing being translucent to facilitate transmission of light through the first surface of the light housing, the light housing being elongated, the plurality of light emitters being arranged longitudinally along the light housing, the light housing containing each of the processor, the receiver, and the light power supply; and an adhesive is coupled to a second side of the light housing opposite the first surface of the light housing, the adhesive mounting the light emitting assembly to an exterior of the piece of luggage.

19. The system of claim 16, further comprising:

a luggage tag being mounted to the piece of luggage, the plurality of light emitters being mounted to the piece of luggage via the luggage tag, the luggage tag having a first end, a second end, and a pair of lateral edges, each lateral edge of the pair of lateral edges extending between the first end and the second end, the plurality of light emitters being arranged along each of the second end and the pair of lateral edges, each of the processor, the receiver, and the light power supply being mounted in the luggage tag, the luggage tag defining a cavity therein, the luggage tag having a first side and a second side being positioned opposite each other and each extending between the first end and the second end and between the pair of lateral edges, a portion of the first side being translucent to facilitated viewing into the cavity through the portion of the first side, the cavity being configured for containing an identification card, the portion of the first side being configured for facilitating viewing the identification card through the portion of the first side; and a key ring being coupled to the first end of the luggage tag for mounting the luggage tag to the piece of luggage.

* * * * *